United States Patent [19]

Saito et al.

[11] 4,428,683

[45] Jan. 31, 1984

[54] ELECTRICAL CONNECTION CONSTRUCTION FOR ELECTRONIC TIMEPIECE

[75] Inventors: Motoyuki Saito; Hideo Hatanaka, both of Tokyo, Japan

[73] Assignee: Citizen Watch Co., Ltd., Tokyo, Japan

[21] Appl. No.: 396,441

[22] Filed: Jul. 8, 1982

Related U.S. Application Data

[62] Division of Ser. No. 159,446, Jun. 13, 1980, Pat. No. 4,403,315.

[30] Foreign Application Priority Data

Jul. 23, 1979 [JP] Japan ..... 54-92621

[51] Int. Cl.[3] ..... G04C 21/16

[52] U.S. Cl. ..... 368/250; 368/88; 368/290

[58] Field of Search ..... 368/318–321, 368/289, 243, 244, 250, 255; 200/5 A, 159 A, 159 B, 159 R

[56] References Cited

U.S. PATENT DOCUMENTS

| | | | |
|---|---|---|---|
| 3,462,943 | 8/1969 | Spadini et al. | 368/250 |
| 4,127,752 | 11/1978 | Lowthorp | 200/5 A |
| 4,128,744 | 12/1978 | Seeger | 200/5 A |
| 4,128,889 | 12/1978 | Ojima et al. | 200/5 A |
| 4,158,115 | 6/1979 | Parkinson et al. | 200/5 A |
| 4,241,246 | 12/1980 | Lugaresi | 200/5 A |
| 4,259,551 | 3/1981 | Ohtani et al. | 200/5 A |
| 4,330,878 | 5/1982 | Nakamura | 368/250 |
| 4,351,041 | 9/1982 | Fukutome et al. | 368/250 |

*Primary Examiner*—Bernard Roskoski

*Attorney, Agent, or Firm*—Bernard, Rothwell & Brown

[57] ABSTRACT

An electronic timepiece assembly interposed between a module and an exteriorly operable member and comprising a switch lower base including a plurality of electrically conductive portions connected to a contact pattern formed on the module and a switch upper plate including a plurality of terminal portions formed in correspondence with the conductive portions and a plurality of projections operable by means of the exteriorly operable member so as to be resiliently deformed and connect the terminal portions through the electrically conductive portions to the contact pattern formed on the module. A button box including a lower case and an upper cover is mounted in an opening in the front side of the timepiece case. The upper cover of the button box includes sound-emitting openings for the alarm and an opening for receiving a button which is arranged to engage a projection on the alarm oscillation plate.

4 Claims, 23 Drawing Figures

ELECTRICAL CONNECTION CONSTRUCTION FOR ELECTRONIC TIMEPIECE

This is a division of application Ser. No. 159,446 filed June 13, 1980 now U.S. Pat. No. 4,403,315.

BACKGROUND OF THE INVENTION

1. Field of the Invention

This invention relates to an electronic timepiece assembly and more particularly to an electrical connection construction interposed between a module of an electronic timepiece provided with an exteriorly operable switch and an exteriorly operable member.

2. Description of the Prior Art

In a conventional electronic timepiece provided with an exteriorly operable switch, a contact pattern is formed on that portion of the upper surface of a module which is located directly below a push button. As a result, when the push button is pushed down, an electrically conductive rubber causes the contact pattern formed on the upper surface of the module to conduct current. As a result, if a large number of push buttons are used for a timepiece having a calculation ability, for example, the upper surface of the module takes up much space in proportion to the number of the push buttons and hence the module is required to be large in size. As a result, a timepiece case for enclosing the large module becomes large in size. In addition, if use is made of a round shaped module, it is impossible to arrange a number of push buttons within the circumference of the round shaped module. Particularly, if the push buttons are arranged in a square shape, a display portion becomes extremely small and hence the module must be made different in shape. As a result, the module working cost becomes high. The conventional construction as described above has the disadvantage that the construction is considerably restricted in design.

In addition, the electronic wrist timepiece has not only a time display ability but also several kinds of abilities such as alarm, stop watch, data display or the like and is provided with several operation buttons for the purpose of selecting these abilities.

These operation buttons are usually composed of independent push buttons and assembled together in a button box mounted on the upper surface of a wrist timepiece case in order to make beautiful in design and reliable in operation.

But, in the push buttons constructed as above described, the top portions of the push buttons are projected upwardly from the button box and the push buttons are operated in up and down directions. As a result, there is a risk of the push buttons being pushed down by accident when the wrist timepiece is used, thereby inducing an erroneous operation. Among the above mentioned several kinds of abilities, the ability of determining the alarm time requires to indicate one point of continuous numerical values, which could not be obtained by ON.OFF operation of the push button.

In addition, in the timepiece having the alarm ability, the timepiece case is provided in its rear cover with sound emitting holes and an alarm oscillation plate is located closely adjacent to the inside of the rear cover. As a result, the timepiece case is required to define a space for enclosing the alarm oscillation plate, whereby the case becomes large in thickness. In addition, when the timepiece is mounted on the user's wrist, the alarm sound is omitted from the rear surface of the case and the sound is filled in a gap formed between the user's wrist and the rear surface of the case, thereby changing the sound into an unpleasant sound.

SUMMARY OF THE INVENTION

A main object of the invention, therefore, is to provide an electronic timepiece assembly which can eliminate the above mentioned drawbacks which have been encountered with the prior art techniques.

Another object of the invention is to provide an electronic timepiece assembly which can provide exteriorly operable elements such as push buttons or the like on the outside of the timepiece without constraint due to size and shape of a module, thereby providing a timepiece which can be designed without constraint and is compact in construction.

A further object of the invention is to provide an electronic timepiece assembly which makes use of a simple electrically conductive connection member composed of a plurality of lead wires laminated with each other and separated one from the other by insulating members for the purpose of connecting a module to exteriorly operable elements and which is extremely small in waterproof positions and hence excellent in waterproof ability.

A still further object of the invention is to provide an electronic timepiece assembly which can provide an electronic timepiece provided with a switch which is simple in construction and reliable in operation.

Another object of the invention is to provide an electronic timepiece assembly which is small in size, but has a sufficiently large contact area and which can prevent contact failure.

A further object of the invention is to provide an electronic timepiece assembly which can prevent an erroneous operation of push buttons and which can improve the operating property of the electronic timepiece.

A still further object of the invention is to provide an electronic timepiece assembly which can incorporate an alarm mechanism together with another exteriorly operable element thereto.

Further objects and advantages of the invention will be fully understood from the following detailed description with reference to the accompanying drawings.

PREFERRED EMBODIMENTS OF THE INVENTION

Figure 1:
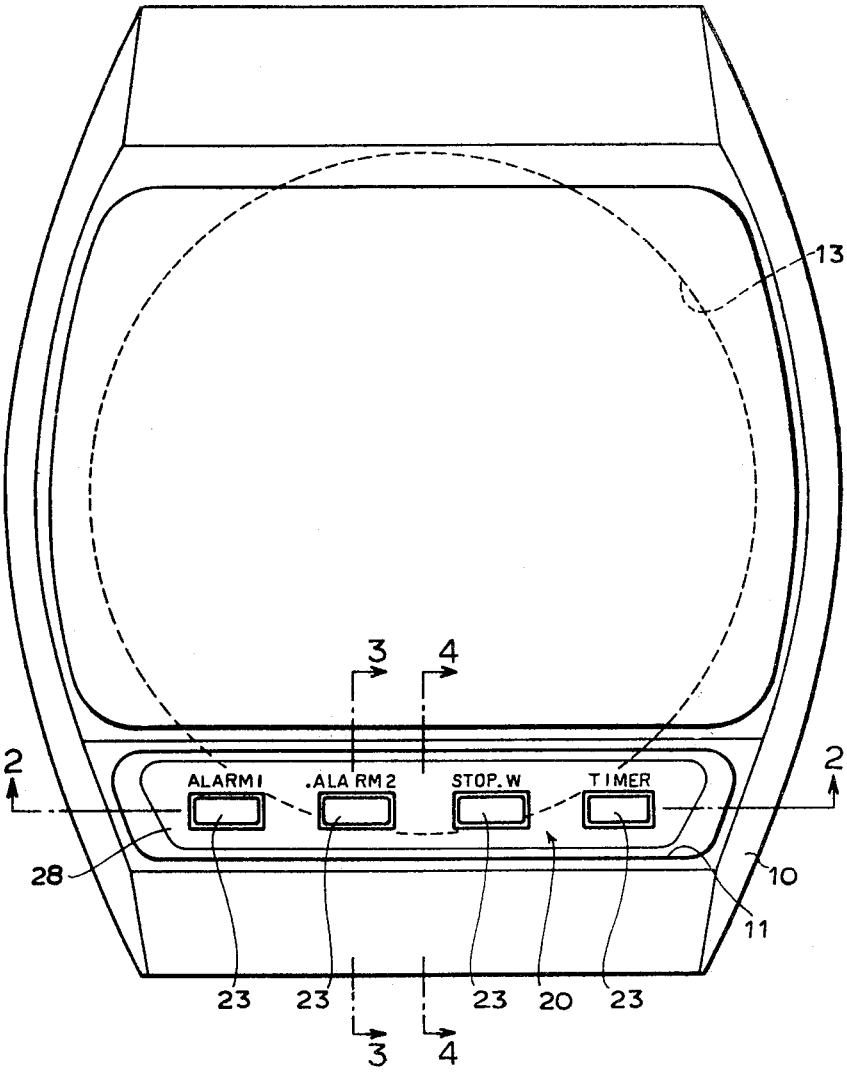
FIG. 1 is a front elevational view of one embodiment of a wrist timepiece according to the invention.
Figure 2:
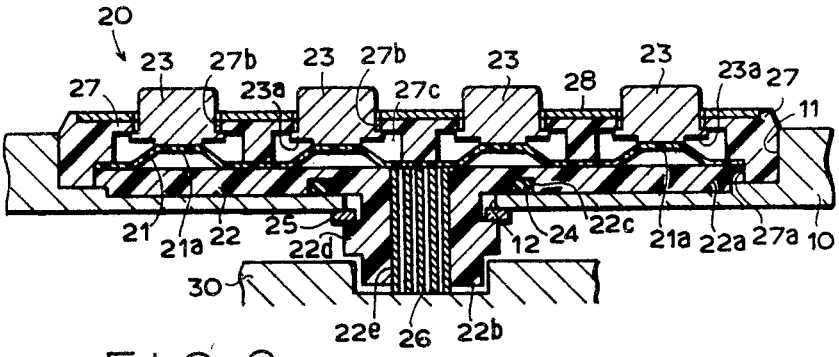
FIG. 2 is a sectional view taken on line 2—2 of FIG. 1.
Figure 3:
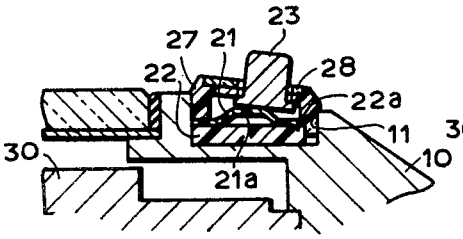
FIG. 3 is a sectional view taken on line 3—3 of FIG. 1.
Figure 4:
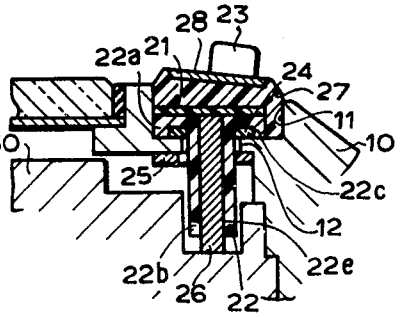
FIG. 4 is a sectional view taken on line 4—4 of FIG. 1.

Referring to FIGS. 1 to 4, a timepiece case 10 is provided at its upper surface with a flat switch unit enclosing portion 11 which is different in shape and adapted to enclose therein a switch unit 20. The switch unit enclosing portion 11 is provided at its center with a rectangular hole 12 through which is extended a switch lower base 22.

The timepiece case 10 is provided at its rear surface with a round module enclosing portion 13 adapted to arrange a module 30 therein and having a portion corresponding to the switch unit enclosing portion 11.

The switch unit 20 is provided as its switch member with a switch upper plate 21 and the switch lower base plate 22, each plate being formed of resin. The switch upper plate 21 is provided at that portion thereof which is opposed to a push button with an upwardly raised resilient projection 21*a*. The switch lower base plate 22 is composed of a substrate 22*a* disposed on the switch unit enclosing portion 11 of the timepiece case 10 and a rectangular shaft portion 22*b* projected downwardly from the lower surface of the substrate 22*a* and extending through the hole 12 formed in the timepiece case 10. The substrate 22*a* is provided at its lower surface with a packing groove 22*c* arranged coaxially around the outer periphery of the hole 12 through which is extended the switch lower base plate 22 and adapted to mount therein a packing 24. The shaft portion 22*b* is provided with a projection 22*d*. An E ring 25 is interposed between the projection 22*d* and the timepiece case 10 and operative to secure the switch lower base plate 22 to the timepiece case 10. The shaft portion 22*b* is provided at its center with a rectangular hole 22*e* through which is extended an electrically conductive connection rubber 26.

The switch upper plate 21 and the switch lower base plate 22 are fitted to a step-shaped portion 27*a* formed in the inner periphery of the lower surface of an outer cover 27 formed of resin. The outer cover 27 is provided at that portion of the switch upper plate 21 which corresponds to the projection 21*a* with holes 27*b* through which are extended push buttons 23 and with seat portions 27*c* which engage with flanges 23*a* of the push buttons 23. The outer periphery of the outer cover 27 is so deformed that it can be fitted to the deformed inner periphery of the switch unit enclosing portion 11 of the timepiece case 10. To the upper surface of the surface cover 27 is secured a name plate 28.

Figure 5:
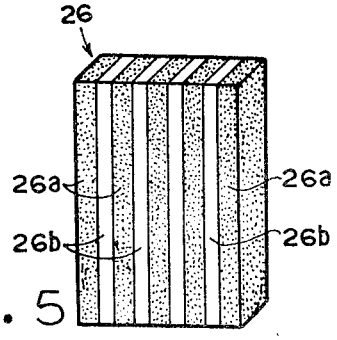
FIG. 5 is a perspective view of an electrically conductive rubber which is one embodiment of an electrically conductive connection member.
Figure 6:
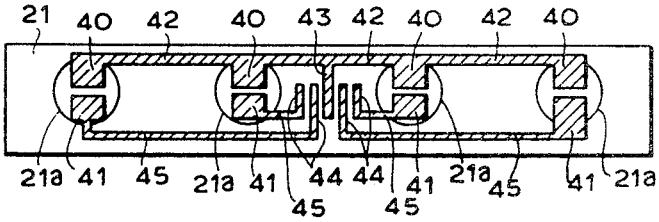
FIG. 6 is a plan view of one embodiment of a transparent switch upper plate according to the invention, electrically conductive patterns formed on the rear surface of the transparent switch upper plate being viewed from the upper surface thereof.
Figure 7:
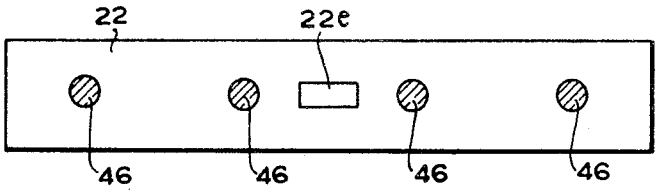
FIG. 7 is a plan view of one embodiment of a switch lower base according to the invention which is opposed to the switch upper plate shown in FIG. 6.

As shown in FIG. 5, the electrically conductive connection rubber 26 is composed of a plurality of electrically conductive portions 26*a* spaced apart from each other so as to form gaps therebetween and a plurality of insulating portions 26*b* each inserted into the gap formed between the electrically conductive portions and made integral into one laminated body. As shown in FIGS. 6 and 7, on the switch upper plate 21 and on the switch lower base 22 are formed electrically conductive patterns, respectively. FIG. 6 shows the electrically conductive pattern formed on the lower surface of the switch upper plate 21 by a screen printing process or the like and viewed through the transparent switch upper plate 21. FIG. 7 shows the electrically conductive pattern formed on the upper surface of the switch lower base 22 by the screen printing process or the like. As shown in FIG. 6, the switch upper plate 21 is provided at its projection 21*a* with a common electrically conductive portion 40 and individual electrically conductive portions 41 spaced apart from the common electrically conductive portion 40 by a given distance. All of these common electrically conductive portions 40 are connected with each other through connection portions 42 which are provided at their center with a terminal portion 43 adapted to make contact with the upper surface of the electrically conductive portion 26*a* located at the center of the electrically conductive connection rubber 26. Provision is made of a plurality of terminal portions 44 adjacent to the terminal portion 43 and adapted to make contact with the upper surfaces of the electrically conductive portions 26*a* of the electrically conductive connection rubber 26. These terminal portions 44 are connected through connection portions 45 to the individual electrically conductive portions 41, respectively. As shown in FIG. 7, the switch lower base 22 is provided with circular electrically conductive portions 46 each corresponding to the common electrically conductive portion 40 and to the individual electrically conductive portion 41.

Assembling of the electronic timepiece constructed as above described will now be described. In the first place, the switch unit 20 is to be assembled. That is, the switch lower base 22 and the switch upper plate 21 are secured together into one integral body by an ultrasonic welding process or the like.

The electrically conductive pattern surfaces of the switch lower base 22 are made opposed to those of the switch upper plate 21. On the one hand, the push buttons 23 are mounted on the surface cover 27. Then, the switch lower base 22 made integral with the switch upper plate 21 is secured to the stepped portion 27*a* of the surface cover 27 provided with the push buttons 23 by a cementing agent or the like. To the surface of the surface cover 27 is secured the name plate 28 by the cementing agent or the like. It is a matter of course that the name plate 28 may be secured beforehand to the surface cover 27. Finally, the electrically conductive connection rubber 26 is mounted in the electrically conductive connection rubber insertion hole 22*e* and the packing 24 is inserted into the packing groove 22*c* formed in the switch lower base 22, thereby completing the assembly of the switch unit 20. Then, the shaft portion 22*b* of the switch unit 20 is aligned with and inserted into the switch lower base insertion hole 12 of the timepiece case 10 as as to mount the surface case 27 in the switch unit enclosing portion 11 of the timepiece case 10. The E ring 25 is forcedly inserted into the upper edge portion of the projection 22*d*, and as a result, the switch unit 20 is secured to the timepiece case 10.

The module 30 is provided on its upper surface with contact patterns (not shown) located at positions corresponding to the electrically conductive portions 26*a* of the electrically conductive connection rubber 26. As a result, if the module 30 is enclosed in the timepiece case 10 from the rear side thereof and second thereto, the lower surfaces of respective electrically conductive portions 26*a* are brought into contact with corresponding contact patterns of the module 30.

As described above, the upper surfaces of the electrically conductive portions 26*a* of the electrically conductive connection rubber 26 make contact with the terminal portions 43, 44 of the switch upper plate 21, so that if any push button 23 is pushed down, the resilient projection 21*a* of the switch upper plate 21 is bent downwardly to bring the common electrically conductive portion 40 and individual electrically conductive portions 41 into contact with the electrically conductive portions 46 of the switch lower base 22. As a result, the terminal portion 43 is connected to the terminal portion 44 corresponding to the push button 23 thus pushed. As a result, the switching operation of the contact pattern of the module 30 in contact with the lower surfaces of the electrically conductive portions 26*a* of the electrically conductive rubber 26 is effected through the electrically conductive portions 26*a* in contact with the terminal portions 43, 44.

The electrically conductive portions 26*a* in contact with the contact pattern of the module 30 are laminated into one integral body as shown in FIG. 5 so that the contact pattern of the module 30 may take up extremely small space and the push buttons 23 may be arranged at the outside of the module 30. As a result, the module is not limited in shape and may be made round and small in size. In addition, it is possible to make the space of the display portion large, arrange a number of push buttons, and obtain various kinds of designs. Moreover, since a number of push buttons are arranged in a unit, the manufacturing cost can be made cheap.

Figure 8:
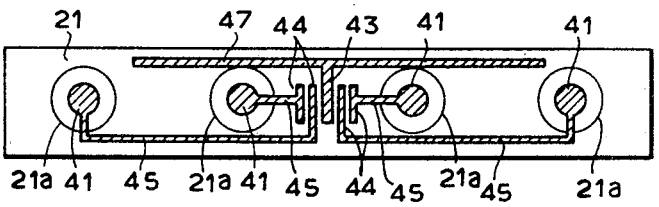
FIG. 8 is a plan view of another embodiment of a switch upper plate according to the invention under the same condition as is of FIG. 6.
Figure 9:
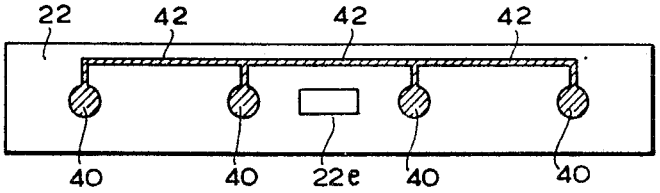
FIG. 9 is a plan view of another embodiment of a switch lower base according to the invention which is opposed to the switch upper plate shown in FIG. 8.

FIGS. 8 and 9 show another embodiment of a pair of electrically conductive patterns formed on the switch upper plate 21 and the switch lower base 22. In FIGS. 8 and 9, the parts corresponding to the electrically conductive patterns shown in FIGS. 6 and 7 are designated by the same reference numerals. In the present embodiment, the switch upper plate 21 is provided at the rear side portions of the projections 21*a* with circular individual electrically conductive portions 41 only. Similar to FIG. 6, these individual electrically conductive portions 41 are connected through the connection portions 45 to the terminal portions 44, respectively. In the present embodiment, the switch lower base 22 is provided at the portions corresponding to the individual electrically conductive portions 41 with the common electrically conductive portions 40 which are connected with each other through the connection portion 42. The switch upper plate 21 is provided with the terminal portion 43 formed thereon and operative to be connected to the connection portion 42. The switch upper plate 21 is provided at that surface thereof which is opposed to the connection portion 42 with a connection portion 47 for the purpose of positively bringing the terminal portion 43 into contact with the connection portion 42 when the switch upper plate 21 and the switch lower base 22 are secured together into one integral body, thereby connecting the common electrically conductive portions 40 to the terminal portion 43.

In the embodiment shown in FIGS. 6 and 7, both the common electrically conductive portions 40 and the individual electrically conductive portions 41 are required to make contact with the electrically conductive portions 46 for the purpose of making the switch ON. As a result, if the projection 21*a* is inclined and deformed due to the pushing mode, dislocation or the like of the push button 23, the switching action becomes degraded. On the contrary, in the embodiment shown in FIGS. 8 and 9, only when the individual electrically conductive portions 41 are brought into contact with the common electrically conductive portions 40, respectively, the switch becomes ON, so that it is possible to obtain a highly reliable switch ability.

Figure 10:
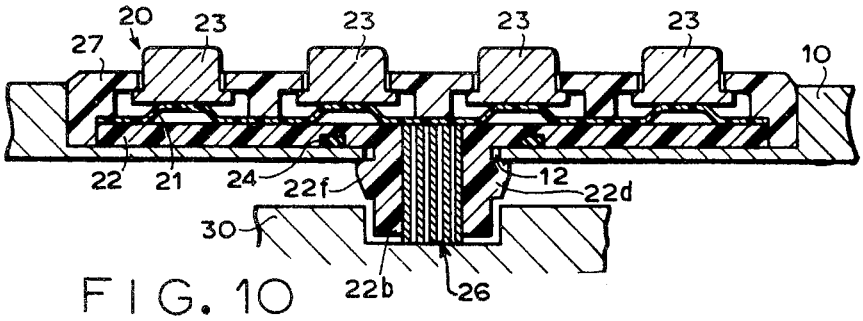
FIG. 10 is a cross-sectional view of another embodiment of an electronic timepiece assembly according to the invention which can fit a switch assembly to a timepiece case.

FIG. 10 shows another embodiment of a construction in which a switch unit 20 is fitted to a timepiece case 10. In the previous embodiment shown in FIG. 2, the switch unit 20 is fitted to the timepiece case 10 by means of the E ring 25. In the present embodiment, a projection 22*d* formed on a shaft portion 22*b* is so formed that the projection 22*d* engages with the lower surfaces of a switch lower base insertion hole 12 and that the lower side of the projection 22*d* is converged so as to form an inverted frustoconical portion 22*f* for the purpose of easily inserting the shaft portion 22*b* into the switch lower base insertion hole 12. The use of such inverted frustoconical portion 22*f* renders it possible to fit the switch unit 20 to the timpiece case 10 by only pushing the shaft portion 22*b* into the switch lower base groove 12. As shown in FIG. 10, the name plate 28 shown in FIG. 2 may be omitted.

Figure 11:
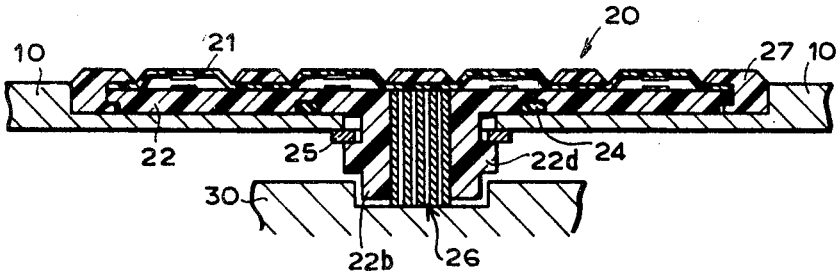
FIG. 11 is a cross sectional view of a further embodiment of an electronic timepiece assembly according to the invention which does not make use of push buttons.

FIG. 11 shows a further embodiment of a switch unit 20 in which the push buttons 23 are omitted and the switch upper plate 21 is directly pushed and deformed. The absence of the push buttons 23 provides the important advantage that the number of parts can be reduced and the switch unit 20 can be made thin in thickness. In the previous embodiments, the switch unit 20 is mounted on the upper surface of the timepiece case 10. Alternatively, the switch unit 20 may be mounted on the side surface of the timepiece case 10. In addition, the electrically conductive connection rubber 26 may be embedded beforehand into the switch lower base 22 and made integral therewith.

FIGS. 12 to 16 show a still further embodiment of an electronic timepiece assembly according to the invention and more particularly show improvement in a contact region between the lower end of the electrically conductive connector and the electrically conductive pattern on the module on the one hand and contact region between the upper end of the electrically conductive connector and the electrically conductive pattern on the switch upper plate on the other hand. In FIG. 12 to 16, the parts corresponding to those shown in FIGS. 1 to 11 are designated by the same reference numerals.

Figure 12:
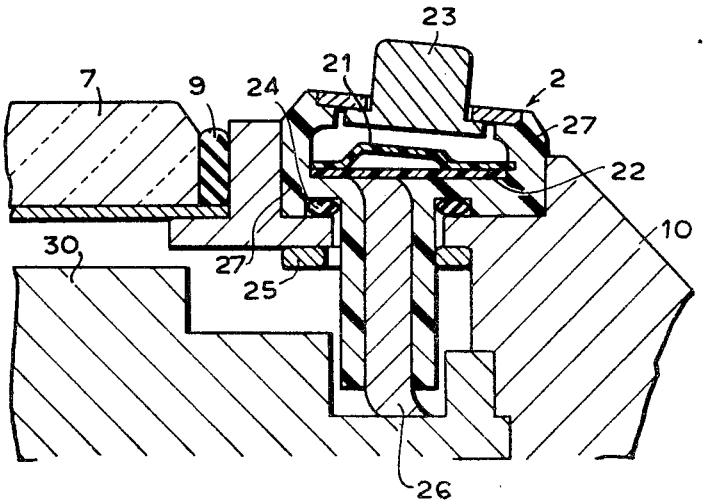
FIG. 12 is a partial sectional view of a still further embodiment of an electronic timepiece assembly according to the invention.

In the embodiment shown in FIG. 12, a wrist timepiece case 10 is provided at one side of the upper surface thereof with a button box 2. The button box 2 is mounted on the timepiece case 10 through a packing 24 interposed therebetween by means of a retainer 25. The case 10 is provided therein with a module 30 operative to control various kinds of abilities of the electronic timepiece. The module 30 is electrically connected through an electrically conductive connector 26 to a contact in the button box 2. Reference numeral 7 designates a transparent body mounted through a packing 9 on the case 10.

Figure 13:
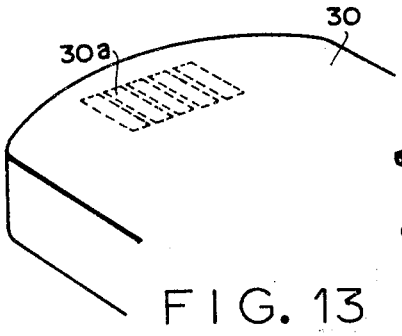
FIG. 13 is a fragmentary perspective view of a modified embodiment of the electronic timepiece assembly shown in FIG. 12.

As seen from FIG. 5, the electrically conductive connector 26 is composed of a resilient body including a plurality of electrically conductive rubber portions **26*a* and corresponding number of insulating portions 26*b* each interposed between adjacent electrically conductive rubber portions 26*a*, 26*a*. As shown in FIG. 13, the electrically conductive connector 26 functions to electrically connect a contact pattern 22*a* formed at the switch side of the switch lower base 22 to a contact pattern 30*a* formed at the module side of the module 30**.

Figure 14:
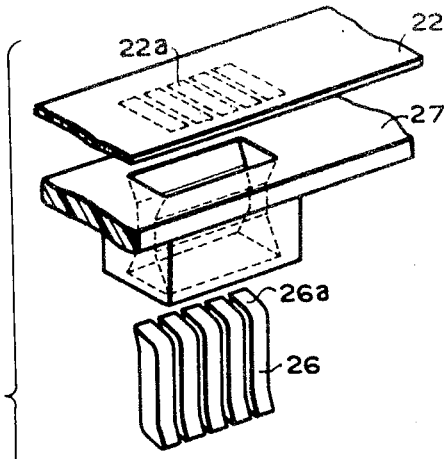
FIG. 14 is a cross-sectional view of essential parts of another modified embodiment of the electronic timepiece assembly shown in FIG. 12.
Figure 14:
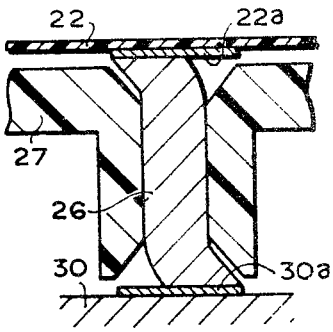

In another embodiment shown in FIG. 13, the electrically conductive connector 26 is divided into a plurality of portions and separated from each other in a direction in parallel with a lengthwise direction of the electrically conductive connector 26. The two end surfaces **26*a* of the electrically conductive connector 26 are inclined at an angle to a plane perpendicular to the lengthwise direction of the electrically conductive connector 26. The electrically conductive patterns 22*a* formed on the lower side of the switch lower base 22 are connected through the upper and lower inclined contact regions 26*a* of the electrically conductive connector 26 to the electrically conductive patterns 30*a* formed on the upper surface of the module 30. As a result, the inclined region 26*a* is wider in contact area than the region formed on a usual plane perpendicular to the lengthwise direction of the connector 26 as shown in FIG. 14. If the inclined contact regions of the electrically conductive connector 26 are inserted under pressure between the switch lower base 22 and the module 30, it is possible to deviate the main contact region from the patterns formed on the switch lower base 22 and from the pattern formed on the module with respect to the longitudinal axis of the connector 26**.

Figure 16:
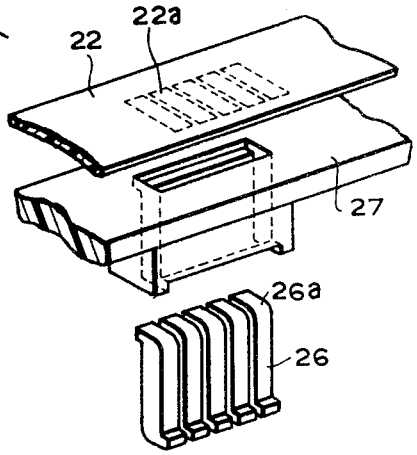
FIG. 16 is a cross-sectional view of essential parts of the electronic timepiece assembly shown in FIG. 15 when the parts are assembled together.
Figure 15:
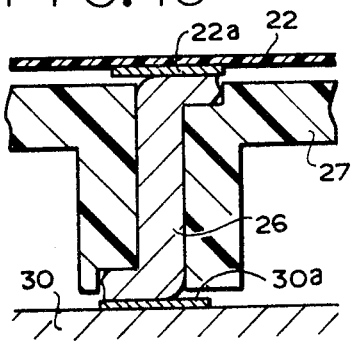
FIG. 15 is a fragmentary perspective view of essential parts of a further modified embodiment of the electronic timepiece assembly shown in FIG. 12.
Figure 15:
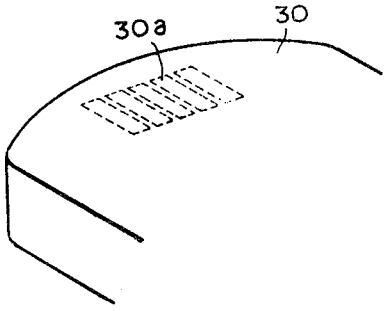

In a further embodiment shown in FIG. 15, the end surfaces **26*a* of the electrically conductive connector 26 are made convex facing outwardly. If the convex contact regions of the electrically conductive connector 26 are inserted under pressure between the switch lower base 22 and the module 30, it is possible to make wide the regions in contact with the pattern 22*a*, 30*a* as shown in FIG. 16. In addition, the two ends of the electrically conductive connector 26** are bent to a direction perpendicular to the lengthwise direction thereof and the rear surface of the bent ends may be used as the contact regions.

In this case, the bent ends may be extended through an opening formed in the switch lower base 22 and engaged with the upper periphery of the opening, so that there is no risk of the electrically conductive connector 26 being removed from the switch lower base 22 during assembly.

Figure 17:
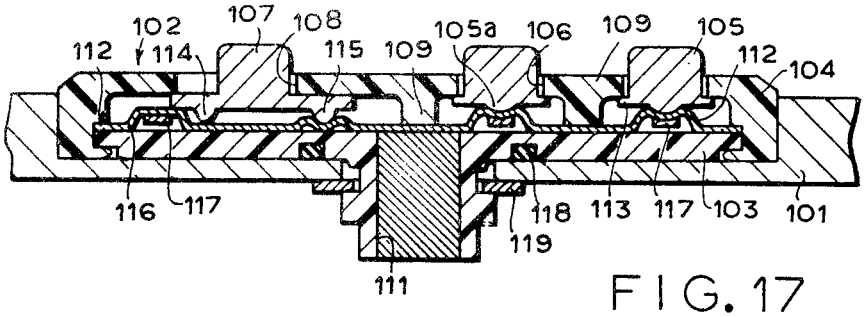
FIG. 17 is a cross-sectional view of another embodiment of an electronic timepiece assembly according to the invention.
Figure 18:
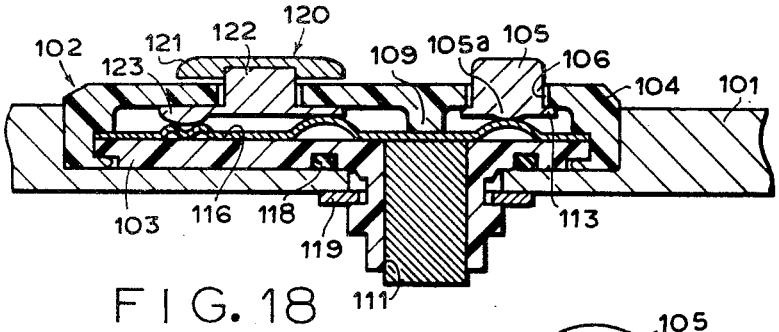
FIG. 18 is a cross-sectional view of a further embodiment of an electronic timepiece assembly according to the invention.
Figure 19:
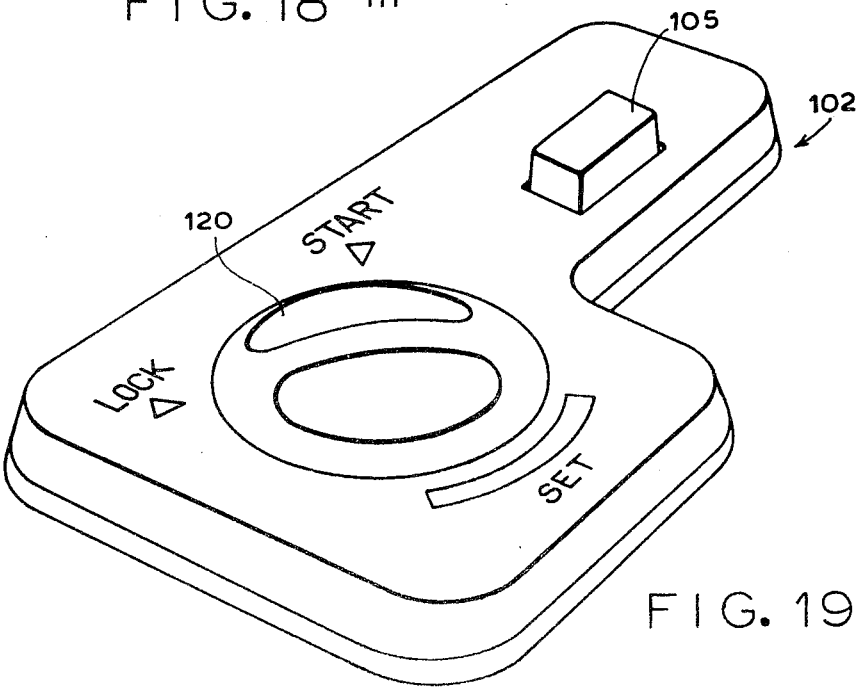
FIG. 19 is a perspective view of the electronic timepiece assembly shown in FIG. 18.

FIGS. 17 to 19 show a still further embodiment of an electronic timepiece assembly according to the invention. In the present embodiment, use is made of a combination of a push button and a slide button as exteriorly operable elements for the purpose of preventing an erroneous operation.

FIG. 17 shows a rectilinear direction moving type slide button constructed as a slide button having a selected position holding ability. In FIG. 17, reference numeral 101 designates a timepiece case and 102 illustrates a button box composed of a lower base 103 and a cover 104.

The cover 104 is formed with an opening 106 corresponding to a push button 105 and with a slide opening 108 corresponding to a slide button 107 and provided at its rear surface with projections 109 operative to support the center part of the cover 104.

The lower base 103 is provided at its upper surface with module patterns (not shown) operative as a selection circuit of each ability and formed by an electrically conductive printing and provided at its center with a lead wire insertion hole 111.

As shown in FIG. 17, the cover 104 is engaged or cemented together with the lower base 103 so as to form an integral body. A stepped portion 112 and the projections 109 define a space inside the cover 104.

The push button 105 is provided at the center of the lower surface thereof with a projection **105*a* and provided at its lower periphery with a rib 113. The push button 105 is uwardly inserted into an opening 106 formed in the cover 104 so as to engage the rib 113 with the lower surface of the peripheral edge of the opening 106. The slide button 107 is provided at its lower portion with two wings which are provided at their lower surfaces with two projections 114, 115. The slide button 107 is upwardly inserted into a slide hole 108 of the cover 104 so as to engage the wings with the lower surface of the cover 104. In the space formed between the cover 104 and the lower base 103 is arranged a rigid film 116 formed of polycarbonate or the like. Those portions of the film 116 which correspond to the projections 105*a* of the button 103 and the projections 114,115 of the slide button 107 are upwardly projected so as to be always urged against the push button 105 and slide button 107**, respectively.

The above mentioned projected portions of the film 116 are provided at their rear surfaces with electrically conductive portions 117. Module patterns formed on the lower base 103 are provided at those positions thereof which are opposed to the electrically conductive portions 117 with contacts for the purpose of closing the circuit when the projections **105*a*, 114, 115** are pushed downwardly by means of the push button or the slide button.

The button box 102 is mounted on the wrist timepiece case 101 by means of a seal packing 118 and retainer 119.

The slide button 107 is moved in a rectilinear direction so as to select two positions which can be held by the engagement of the projections of the film 116 with the projection 114 or 115 of the slide button 107. As a result, there is no risk of the slide button 107 being moved by accident, so that it is possible to prevent the erroneous operation. If the slide button 107 has an ability of electrically locking or releasing the selection ability of the other push button 105, the slide button 107 held at its selected portion can prevent the push button 105 from eliminating its selected ability even when the push button is erroneously operated.

FIGS. 18 and 19 show a rotary button 120 operative to rotate about one shaft and having a selected position holding ability in the same manner as the slide button shown in FIG. 17. Similar to the embodiment shown in FIG. 17, the rotary button 120 and the push button 105 are mounted on the button box 102. The rotary button 120 is composed of a knob portion 121 and a body portion 122 provided at its lower surface with a large diameter disc-shaped portion. The disc-shaped portion is provided at its lower surface with one or plurality of projections 123. A film 116 is provided with projections arranged along a rotary locus of the projections 123. The film 116 functions to upwardly push the push button 105 and rotary button 120 and closing the contact of the module pattern printed on the lower base 103 when the film 116 is pressed downwardly by means of the projections of the push button 105 and rotary button 120. Such ability of the film 116 is the same as that of the slide button 107 shown in FIG. 17.

The rotary button 120 is different in operation from the push button 105. That is, the rotary button 120 functions to select any one of a plurality of contacts arranged along the locus of a projection 123 or stop at one point of continuous numerical values. In addition, the rotary button 120 can be held at the selected contact by means of the projection of the film 116. In the usual use of the wrist timepiece, there is no risk of the rotary button 120 being rotated by accident.

As shown in FIG. 19, if the rotary button 120 functions to lock or release the ability of the push button 105 or determine any alarm time, there is no risk of the selected ability of the push button 105 being eliminated by accident even when the push button is erroneously operated. In addition, if the rotary button functions to determine any alarm time, the rotary button becomes easier in operation and simpler in construction than the push button.

FIGS. 20 to 23 show another embodiment of an electronic timepiece assembly according to the invention. In FIGS. 20 to 23, reference numeral 201 designates a wrist timepiece case provided at one side portion of the upper surface thereof with a button box 202.

Figure 21:
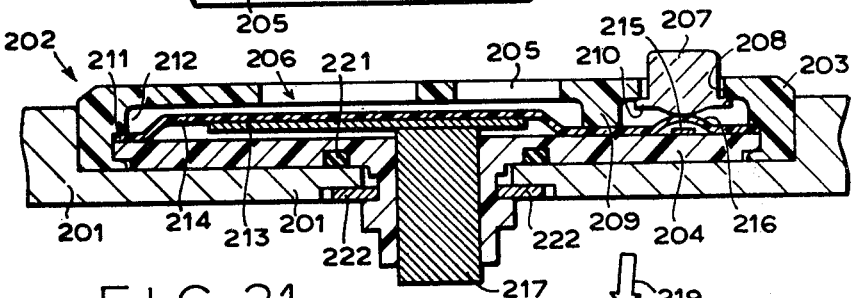
FIG. 21 is a longitudinal sectional view taken on line through a push button of the electronic timepiece assembly shown in FIG. 20.

As shown in FIG. 21, the button box 202 is composed of an upper cover 203 and a lower base 204. The cover 203 is provided with a region 206 including a number of sound emitting slits 205, an opening 208 through which is extended a push button 207 and a projection 209 located at the boundary between the opening 208 and the region 204 and supporting the inside of the center of the cover 203.

The push button 207 is provided at its lower periphery with a rib 201 and is inserted into the opening 208 so as to cause the rib 210 to be engaged with the rear surface of the opening 208.

The lower base 204 is made integral with the inner peripheral edge ofthe cover 203 by engagement, cementing or the like so as to form a space 212 between the cover 203 and the lower base 204 by means of the stepped portion at the peripheral edge 211 and projection 209 of the cover 203.

In the above mentioned region 206 in the space 212 are arranged an alarm oscillation plate 214 provided at its rear surface with a piezoelectric element 213 and a contact 215 located at a position directly below the push button 207.

In the present embodiment, the alarm oscillation plate 214 is composed of a hard film formed of polycarbonate and fitted under pressure between the lower base 204 and the peripheral edge of the cover 203. That portion of the alarm oscillation plate 214 which is opposed to the lower projection of the push button 207 is provided with a projection 216 operative to normally urge the push button 207 upwardly by utilizing the elastic property of the alarm oscillation plate 214. The alarm oscillation plate 214 is separated from the projection 216 by means of the projection 209 of the cover 203, so that if the alarm oscillation plate 214 is formed of metals, it is possible to improve the alarm sound to be emitted therefrom.

To the piezoelectric element 213 is supplied electric power through an electrically conductive rubber 217 extending through the center hole of the lower base 204. The electrically conductive rubber 217 is electrically connected through a module pattern inclusive of the contact 215 and formed on the upper surface of the lower base 204 by means of an electrically conductive printing process to a control device arranged in the timepiece.

Figure 20:
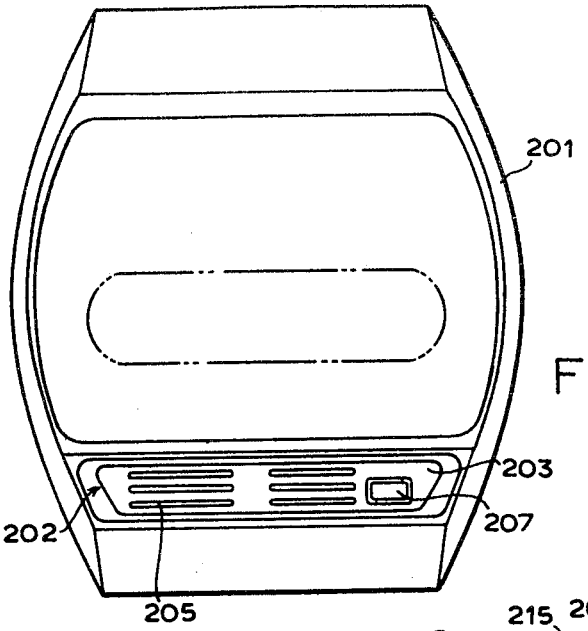
FIG. 20 is a plan view of a wrist timepiece constructed by a still further embodiment of an electronic timepiece assembly according to the invention.

As shown in FIGS. 20 and 21, the button box 202 is substantially rectangular in shape, but such shape or design thereof is not limited. It is preferable that the button box 202 may be formed of a hard plastic having an insulating property, but is not particularly limited thereto.

Figure 22:
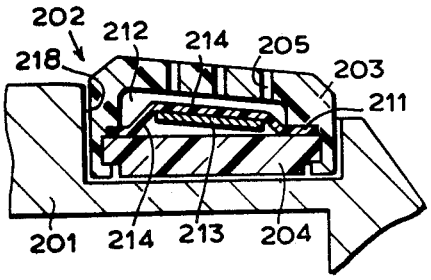
FIG. 22 is a cross-sectional view taken on line through holes in a direction perpendicular to their lengthwise direction of the electronic timepiece assembly shown in FIG. 20.
Figure 23:
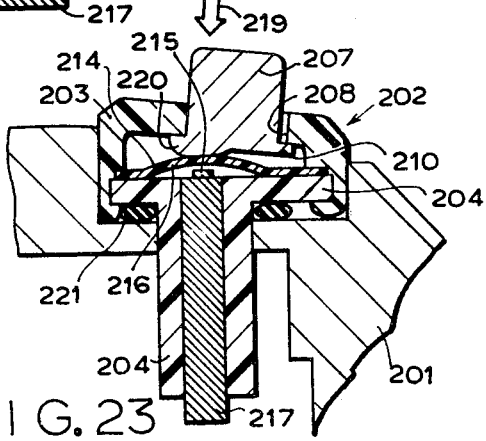
FIG. 23 is a cross-sectional view taken on line through a push button of the electronic timepiece assembly shown in FIG. 20.

As shown in FIG. 22, the upper surface of the cover 203 of the button box 202 may be inclined at an angle which is equal to that of the wrist timepiece case 201. In this case, any foreign matter is less collected in the cover 203 and the wrist timepiece case becomes excellent in design. In this case, if the lower base 204 remains horizontal, a groove used for mounting the button box on the wrist timepiece case 201 can easily be worked.

In the case of inclining the upper surface of the cover 203, it is preferable in design to also incline the push button 207 and cause the push button 207 to move in a direction perpendicular to the inclined upper surface of the cover 203. It is also preferable to project that portion 220 of the lower surface of the push button 207 which corresponds to the upper side of the inclined push button 207 and locate the contact 215 at a position directly below the projection 220 by taking the direction of the finger force 219 urged against the push button 207 and shown by an arrow.

As shown in FIG. 21, the lower base 204 is mounted on the wrist timepiece case 201 by means of a packing 221 and retainer 222.

If use is made of the push button 207 so as to set the alarm time, an electric power supplied from a control device through the electrically conductive rubber 217 causes the piezoelectric element 213 and hence the alarm oscillation plate 214 to oscillate, thereby emitting the alarm sound. As a result, the sound emitted from the alarm oscillation plate 214 passes directly upwardly through openings 205 and reaches one's ears.

As stated hereinbefore, the electronic timepiece provided with the exteriorly operable switch according to the invention has a number of advantages. In the first place, a combination of a switch lower base including a plurality of electrically conductive portions closely separated from each other and electrically connected to a contact pattern formed on a module and a switch upper plate including a plurality of terminal portions formed in correspondence with the above mentioned plurality of electrically conductive portions and electrically connected thereto and a plurality of projections directly or indirectly operable from the outside so as to be resiliently deformed and brought into contact with the switch lower base, whereby a switch portion is formed and the above mentioned terminal portions are connected to the switch portion so as to constitute a switch for a contact pattern of the module, allows to freely select the shape of the module, freely arrange the exteriorly operative members such as push buttons or the like, provide various kinds of designs and make the size small. Secondly, the switch portion is provided at its projections on the switch upper plate with individual electrically conductive portions and provided at those positions of the switch lower base which are opposed to the individual electrically conductive portions with a common electrically conductive portion, whereby a switch action is displayed only when the individual electrically conductive portions are brought into contact with the common electrically conductive portion, thereby obtaining a highly reliable switch ability. Third, the use of wide regions formed on both ends of the electrically conductive connector and brought into contact with the contact pattern formed at the module side and with the contact pattern formed at the switch side ensures an increase of the contact area between the ends of the connector and the contact patterns, and as a result, there is no risk of the contact being deteriorated and the button box can positively and easily be connected to the module. If use may be made of a conventional contact region, it is possible to make the electrically conductive connector small in thickness, width and size. Fourth, the use of the button box comprising in combination the push button mounted on the upper surface of the wrist timepiece case and the slide button having the selected position holding ability and mounted on the upper surface of the case ensures an elimination of a vital failure of the push button due to its erroneous operation without deteriorating the excellent operation ability of the push button and ensures an improvement in the operative property of the timepiece. This is because of the fact that the slide button having the selected position holding ability is more conveniently used than the push button in the case of selecting the time to one point of continuous numerical values and maintaining the set condition thus selected. Fifth, the use of the alarm sound emitting member mounted on the surface portion of the wrist timepiece case causes natural sound to be emitted without filling the timepiece with the sound, which is frequently encountered when the alarm sound emitting member is mounted on the rear surface of the wrist timepiece. Finally, the oscillation plate of the alarm device and the push button mechanism are made integral into one body and incorporated into the button box, so that it is not necessary to incorporate the alarm device separately from the push button mechanism, thereby making the wrist timepiece case small in thickness.

What is claimed is:

1. An electronic timepiece assembly comprising a switch upper plate having a contact pattern formed on the lower surface thereof, said contact pattern including a plurality of spaced terminals, a connector having a plurality of spaced electrical conductors engaging said terminals at the upper ends of said conductors and adapted to engage a module at the lower ends of said conductors, said switch upper plate contact pattern further including a plurality of spaced terminal portions, a switch lower base having a plurality of spaced electrically conductive elements on the upper surface thereof, each of said conductive elements being disposed in alignment with a corresponding pair of said terminal portions on said switch upper plate, and a plurality of projections operable from the outside so as to be resiliently deformed and bring a selected pair of said spaced terminal portions and a corresponding one of said conductive elements into engagement to complete a selected circuit, said electronic timepiece assembly further including a case within which said switch upper plate and said switch lower plate are disposed, a button box mounted in said timepiece case and including a lower button box case and an upper cover having said sound-emitting slits therein, an oscillation plate disposed between said upper cover and said lower button box case, said upper cover also including a button-receiving opening therein disposed laterally of said slits, a movable button received in said opening, said oscillation plate including a first alarm sound-emitting portion extending below said slits and a second portion extending below said button, said second portion including a projection engageable by said button.

2. The electronic timepiece assembly of claim 1 wherein the upper surface of said upper cover of said button box is inclined, and said pushbutton is inclined so as to move in a direction perpendicular to said upper surface.

3. An electronic timepiece assembly comprising a switch upper plate having a contact pattern formed on the lower surface thereof, said contact pattern including a plurality of spaced terminals, a connector having a plurality of spaced electrical conductors engaging said terminals at the upper ends of said conductors and adapted to engage a module at the lower ends of said conductors, said switch upper plate contact pattern further including a plurality of spaced terminal portions, a switch lower base having a plurality of spaced electrically conductive elements on the upper surface thereof, each of said conductive elements being disposed in alignment with a corresponding pair of said terminal portions on said switch upper plate, and a plurality of projections operable from the outside so as to be resiliently deformed and bring a selected pair of said spaced terminal portions and a corresponding one of said conductive elements into engagement to complete a selected circuit, said electronic timepiece assembly further including a case within which said switch upper plate and said switch lower plate are disposed, a button box mounted in said timepiece case and including a lower button box case and an upper cover having said sound-emitting slits therein, an oscillation plate disposed between said upper cover and said lower button box case, said upper cover also including a button-receiving opening therein disposed laterally of said slits, a movable button received in said opening, said oscillation plate including a first alarm sound-emitting portion extending below said slits and a second portion extending below said button, said second portion including a projection engageable by said button, and said cover including a depending member engaging said oscillation plate between said first and second portions thereof for separating said projection from said sound-emitting first portion.

4. The electronic timepiece assembly of claim 3 wherein the upper surface of said upper cover of said button box is inclined, and said pushbutton is inclined so as to move in a direction perpendicular to said upper surface.

* * * * *

UNITED STATES PATENT AND TRADEMARK OFFICE

CERTIFICATE OF CORRECTION

PATENT NO. : 4,428,683

DATED : January 31, 1984

INVENTOR(S) : Motoyuki Saito et al.

It is certified that error appears in the above-identified patent and that said Letters Patent is hereby corrected as shown below:

Column 1, line 59, "ON.OFF should read --ON·OFF--.

Column 1, line 68, "omitted" should read --emitted--.

Column 5, line 39, "second" should read --secured--.

Column 7, line 18, "FIG." should read --FIGS.--.

Column 8, line 46, "uwardly" should read --upwardly--.

Column 9, line 32, "closing" should read --close--.

Column 10, line 6, "ofthe" should read --of the--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*